United States Patent [19]

Stein et al.

[11] Patent Number: 4,678,927

[45] Date of Patent: Jul. 7, 1987

[54] CIRCUIT ARRANGEMENT FOR LARGE POWER TRANSFORMERS

[75] Inventors: Werner Stein, Nuremberg; Walter Müller, Schwabach, both of Fed. Rep. of Germany

[73] Assignee: Transformatoren Union Aktiengesellschaft, Stuttgart, Fed. Rep. of Germany

[21] Appl. No.: 662,239

[22] Filed: Oct. 18, 1984

[30] Foreign Application Priority Data

Oct. 20, 1983 [DE] Fed. Rep. of Germany ..... 3338149

[51] Int. Cl.[4] ..... H01F 37/00

[52] U.S. Cl. ..... 307/104; 307/105; 323/340; 363/48; 361/3; 336/146

[58] Field of Search ..... 307/104–110, 307/83; 323/364, 365, 340, 342, 352, 344, 345, 259, 908, 353, 341, 256, 209, 218, 233; 361/35, 36, 37, 2–10; 219/130.1, 130.51; 336/145, 146, 150, 170, 184

[56] References Cited

U.S. PATENT DOCUMENTS

| | | | |
|---|---|---|---|
| 2,172,677 | 9/1939 | Hathaway | 307/105 |
| 2,395,116 | 2/1946 | Grandstaff | 361/4 X |
| 2,547,614 | 4/1951 | Bedford | 361/8 |
| 3,419,792 | 12/1968 | Kasper et al. | 307/87 X |
| 3,601,622 | 8/1971 | Waaben | 361/9 |
| 3,684,949 | 8/1972 | Yamachi et al. | 361/3 X |
| 3,794,850 | 2/1974 | Hirose | 361/2 X |
| 4,041,357 | 8/1977 | Clark | 361/6 |
| 4,090,225 | 5/1978 | Gilker et al. | 361/3 |
| 4,363,060 | 12/1982 | Stich | 361/8 |
| 4,389,691 | 6/1983 | Hancock | 361/3 X |
| 4,392,173 | 7/1983 | Rubin | 361/35 |
| 4,459,629 | 7/1984 | Titus | 361/8 X |

FOREIGN PATENT DOCUMENTS

| | | | |
|---|---|---|---|
| 732163 | 1/1943 | Fed. Rep. of Germany | 323/340 |
| 311893 | 4/1928 | United Kingdom | 363/48 |
| 1031813 | 11/1961 | United Kingdom | 323/340 |

OTHER PUBLICATIONS

IBM Technical Disclosure Bulletin, vol. 14, No. 9, Feb. 1972, p. 2805.

*Primary Examiner*—William M. Shoop, Jr.
*Assistant Examiner*—Shik Luen Paul Ip
*Attorney, Agent, or Firm*—Herbert L. Lerner; Laurence A. Greenberg

[57] ABSTRACT

A circuit arrangement for large power transformers with a low-voltage winding, a main high-voltage winding and a step winding as well as a step switching device at a Y-point side thereof, includes, at a location between a point connecting the step winding to the high-voltage main winding and the Y-point of the transformer, a capacitor in series with a resistor is connected electrically parallel to respectively current-carrying steps of the step winding, the capacitor and the resistor being of such dimensions as to decrease resonance amplitudes of the connecting point to ground, the capacitor being constructed of spirally wound strip lines formed of a resistance alloy, the strip lines being also of such dimensions as to reduce resonance amplitudes of the connecting points.

4 Claims, 2 Drawing Figures

CIRCUIT ARRANGEMENT FOR LARGE POWER TRANSFORMERS

SPECIFICATION

Figure 1:
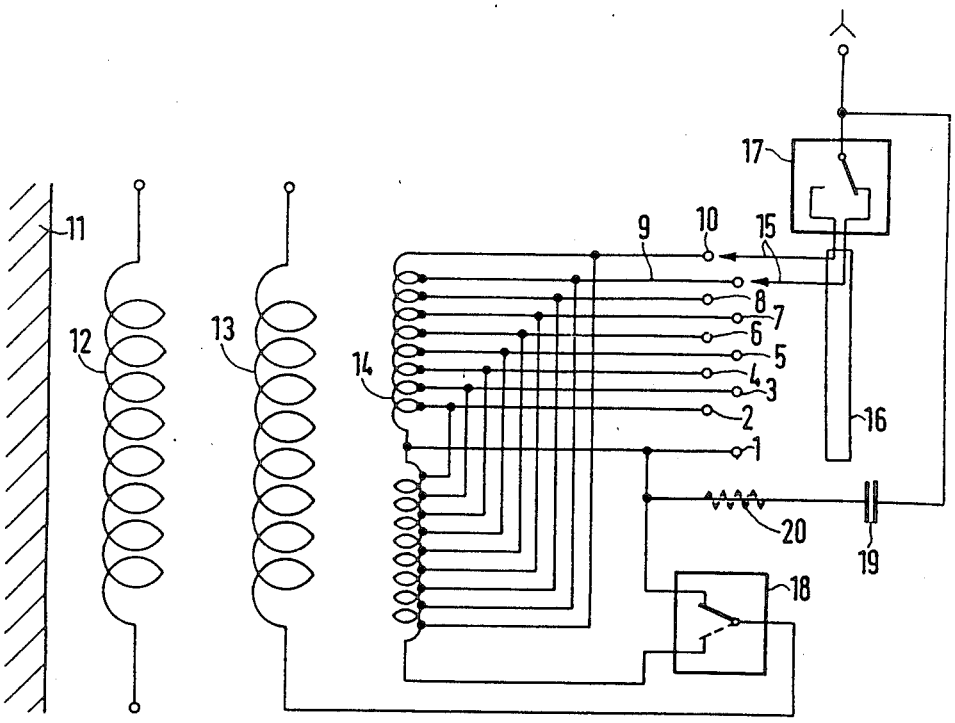

The invention relates to a circuit arrangement for large power transformers with a low-voltage winding, a main high-voltage winding and a step winding with additive and opposing connection as well as a step-switching device at a Y-point side thereof, the step-winding being formed, for example, out of two electrically parallel, centrally symmetrical parts.

Transformer windings have definite resonance frequencies. An externally applied oscillating switching voltage can excite these resonant oscillations when the frequencies coincide, and can cause very large internal voltage stresses for the insulation of the winding. When high-voltage windings are formed of a main winding and a corresponding step winding with additive and opposing connection, the oscillations with the resonance frequency of the step winding can be particularly disagreeable. In certain positions of the step switch, especially in the opposing connection, these voltage oscillations also have an influence upon the end of the main winding and lead also there to voltage peaks and thereby endanger the insulation.

The ratio of the resonance amplitude at the end of the main winding to the switching voltage amplitude at the input is calculated as $$\frac{U_R}{U_1} = \sqrt{n_C^2 + Q^2(n_C - n_T)^2}$$

where $n_C$=capacitive transformation ratio of main winding step winding, $n_T$=inductive transformation ratio of main winding step winding (<O for opposing conenction)

Q=at the resonance frequency of the step winding. In order to reduce the resonance amplitudes at this point, it has been suggested heretofore to arrange spatially between the main and the step winding an electrostatic shielding cylinder which is tied to the Y-point potential and decouples the two windings electrically from one another ($n_C \rightarrow O$). This shielding cylinder, however, is technically difficult to realize and, in addition, takes up valuable space in the core window of the transformer, so that the latter is made larger and more expensive by the shielding provision.

From German Patent No. 23 28 375, it has also become known heretofore to use a capacitor battery of individual capacitors for controlling the voltage in windings and transformers, every winding section to be controlled being shunted by an individual capacitor. When a step winding thus wired capacitively and opposingly is excited to resonance, the resonance amplitudes are reduced in such a manner that the capacitively transmitted voltage i.e. $n_C$, is reduced. The Q-factor of the winding is virtually uninfluenced by these wiring connections.

It is therefore an object of the invention to provide a circuit arrangement for large power transformers which harmlessly absorb voltage surges stemming from oscillating switching voltages by means of transformer windings without requiring an enlargement of the transformer core window, and which also limit the remaining space to a minimum required.

With the foregoing and other objects in view, there is provided, in accordance with the invention, a circuit arrangement for large power transformers with a low-voltage winding, a main high-voltage winding and a step winding as well as a step switching device at a Y-point side thereof, comprising, at a location between a point connecting the step winding to the high-voltage main winding and the Y-point of the transformer, a capacitor in series with a resistor is connected electrically parallel to respectively current-carrying steps of the step winding, the capacitor and the resistor being of such dimension as to decrease resonance amplitudes of the connecting point to ground, the capacitor being constructed of spirally wound strip lines formed of a resistance alloy, the strip-lines being also of such dimensions as to reduce resonance amplitudes of the connecting points.

Thus, an R-C stage formed of an ohmic resistance and a capacitor coil in series is located between the connection of the step winding to the main high-voltage winding and the Y-point i.e. parallel to the steps respectively with opposite sense.

In accordance with other features of the invention, the resistance and capacity are combined in a single component, the condenser coils being wound of strip-lines formed of a resistance alloy, and the series circuit of the individual capacitor coil groups having resistance are connected by means of interconnections to the step terminals of the step winding and thereby also attenuate the higher-order resonance frequencies of the step winding affectively.

The circuit arrangement according to the invention is very advantageous because it assures optimum protection of the step winding against oscillating voltage switching surges. If the step winding is resonance-excited, additional damping is achieved in an advantageous manner without measurable increase of the winding losses at the operating frequency.

Other features which are considered as characteristic for the invention are set forth in the appended claims.

Although the invention is illustrated and described herein as embodied in a circuit arrangement for large power transformers, it is nevertheless not intended to be limited to the details shown, since various modifications and structural changes may be made therein without departing from the spirit of the invention and within the scope and range of equivalents of the claims.

Figure 2:
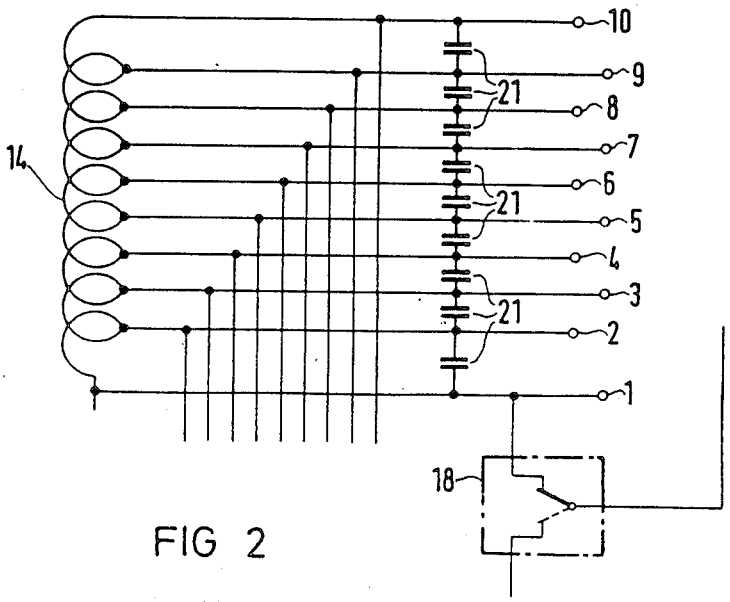

The construction and method of operation of the invention, however, together with additional objects and advantages thereof will be best understood from the following description of specific embodiments when read in connection with the accompanying drawings, in which:

FIG. 1 is a diagram of a circuit arrangement according to the invention having a single capacitor; and FIG. 2 is a diagram of a circuit arrangement according to the invention having a capacitor subdivided into capacitor sections.

Mutually corresponding components are identified by the same reference characters in both of the figures.

Referring now to the drawing and, first, particularly to FIG. 1 thereof, there are shown a low-voltage winding 12, a main high-voltage winding 13 as well as a step winding 14 having steps 1 to 10, all of the windings being arranged in a conventional manner concentrically in succession from inside to outside around a core leg 11. The step winding 14 is made up of two electrically parallel parts which are arranged spatially symmetrically to a central input corresponding to the step 1.

The steps 1 to 10 are selectable by contact arms 15 of a selector 16 and a respective one of the contact arms 15 is connected to the Y-point of the transformer by a load switch 17 operating without interruption. The central input and the ends of the step winding 14 are connected to fixed contacts in a reverser 18, which also has a movable contact connected to the low-voltage end of the high-voltage main winding 13. By appropriate realization of the winding sense or direction of the high-voltage main winding 13, and in the two parts of the step winding 14, the voltages of the windings 13 and 14 are added together in the switched position of the reverser 18 shown in broken lines, and subtracted from one another in the switched position of the reverser 18 shown in solid lines.

According to the invention, there is then connected between the central terminal of the step winding 14 and the Y-point of the transformer, a capacitor 19, which greatly reduces the capacitively transmitted voltage. The capacitor 19 is preceded by a damping resistor 20 for attenuating its charging currents and for reducing the Q-factor.

FIG. 2 shows a circuit arrangement, wherein the capacitor is a capacitor battery subdivided into capacitor sections 21. Using a capacitor battery of capacitor sections 21 permits, moreover, production thereof out of double-turned coils of a strip line and a resistance alloy wound within one another. Additional damping of the step winding 14 is accordingly possible without measurably increasing its losses occuring at the operating frequency.

The foregoing is a description corresponding in substance to German Application P 33 38 149.6, filed Oct. 20, 1983, the International priority of which is being claimed for the instant application, and which is hereby made part of this application. Any material discrepancies between the foregoing specification and the aforementioned corresponding German application are to be resolved in favor of the latter.

We claim:

1. Circuit arrangement for large power transformers with a low-voltage winding, a main high-voltage winding and a step winding as well as a step switching device at a Y-point side thereof, comprising, at a location between the center of the step winding connecting the step winding to the high-voltage main winding and the Y-point of the transformer, a capacitor in series with a resistor connected electrically parallel to respectively voltage-addingly connected current-carrying steps of the step winding, said capacitor and said resistor being of such dimensions as to decrease resonance amplitudes of said connecting point to ground, said capacitor being constructed of spirally wound strip lines formed of a resistance alloy, said strip lines being also of such dimensions as to reduce resonance amplitudes of said connecting points.

2. Circuit arrangement according to claim 1, wherein said capacitor is split into capacitor sections connected electrically in parallel with the individual steps of the step winding and are connected in series with one another.

3. Circuit arrangement according to claim 2 wherein said capacitor sections are of equal capacities.

4. Circuit arrangement according to claim 2, wherein all of the capacitor sections associated with the same phase of a polyphase transformer are combined in a columnar subassembly separated from the step winding.

* * * * *